US007165933B2

(12) United States Patent
Gerstenberg

(10) Patent No.: US 7,165,933 B2
(45) Date of Patent: Jan. 23, 2007

(54) SCREW PUMP FOR TRANSPORTING EMULSIONS SUSCEPTIBLE TO MECHANICAL HANDLING

(75) Inventor: Knud Aage Gerstenberg, Frederiksberg C (DK)

(73) Assignee: KAG Holding A/S, Frederiksberg (DK)

( * ) Notice: Subject to any disclaimer, the term of this patent is extended or adjusted under 35 U.S.C. 154(b) by 209 days.

(21) Appl. No.: 10/496,255

(22) PCT Filed: Dec. 2, 2002

(86) PCT No.: PCT/DK02/00808

§ 371 (c)(1),
(2), (4) Date: May 21, 2004

(87) PCT Pub. No.: WO03/048579

PCT Pub. Date: Jun. 12, 2003

(65) Prior Publication Data

US 2005/0008510 A1 Jan. 13, 2005

(30) Foreign Application Priority Data

Dec. 4, 2001 (DK) ..... 2001 01801

(51) Int. Cl.
*F01D 5/00* (2006.01)

(52) U.S. Cl. ..... 415/72; 415/73; 415/415; 415/75

(58) Field of Classification Search ..... 415/72, 415/73, 75; 416/176, 177; 418/85, 90, 92, 418/201.1

See application file for complete search history.

(56) References Cited

U.S. PATENT DOCUMENTS 2,099,937 A * 11/1937 Lauterbur ..... 366/181.6
2,111,568 A * 3/1938 Lysholm et al. ..... 418/180
3,092,017 A 6/1963 French et al.
3,720,479 A * 3/1973 Latinen ..... 416/198 R
3,795,117 A 3/1974 Moody, Jr. et al.
4,245,983 A 1/1981 Lindroos
4,541,792 A 9/1985 Zakic (Continued)

FOREIGN PATENT DOCUMENTS

DE 198 17 351 A1 4/1998

(Continued)

OTHER PUBLICATIONS

Gates Corporation, 1999-2006, URL: http://www.gates.com/brochure.cfm?brochure=2625&location_id=3046.*

*Primary Examiner*—Hoang Nguyen
(74) *Attorney, Agent, or Firm*—Volpe & Koenig, P.C.

(57) ABSTRACT

A screw pump for transporting a viscous product is described comprising a cylindrical housing connected to a removable bottom piece in one end and a removable cap in the opposite end, a rotor having one or more screw blades connected to a driving motor, an inlet and an outlet wherein the cylindrical housing is provided with a jacket for supply or removal of heat, and the rotor is provided with one or more internal channels connected to an inlet and an outlet for supply or removal of heat. Such a screw pump is suitable for pumping emulsion susceptible to mechanical or temperature damage. Food emulsions manufactured with reduced or without addition of emulsifiers may be transported using such a pump without mechanical damage to the emulsion.

24 Claims, 1 Drawing Sheet

U.S. PATENT DOCUMENTS

Figure 1:
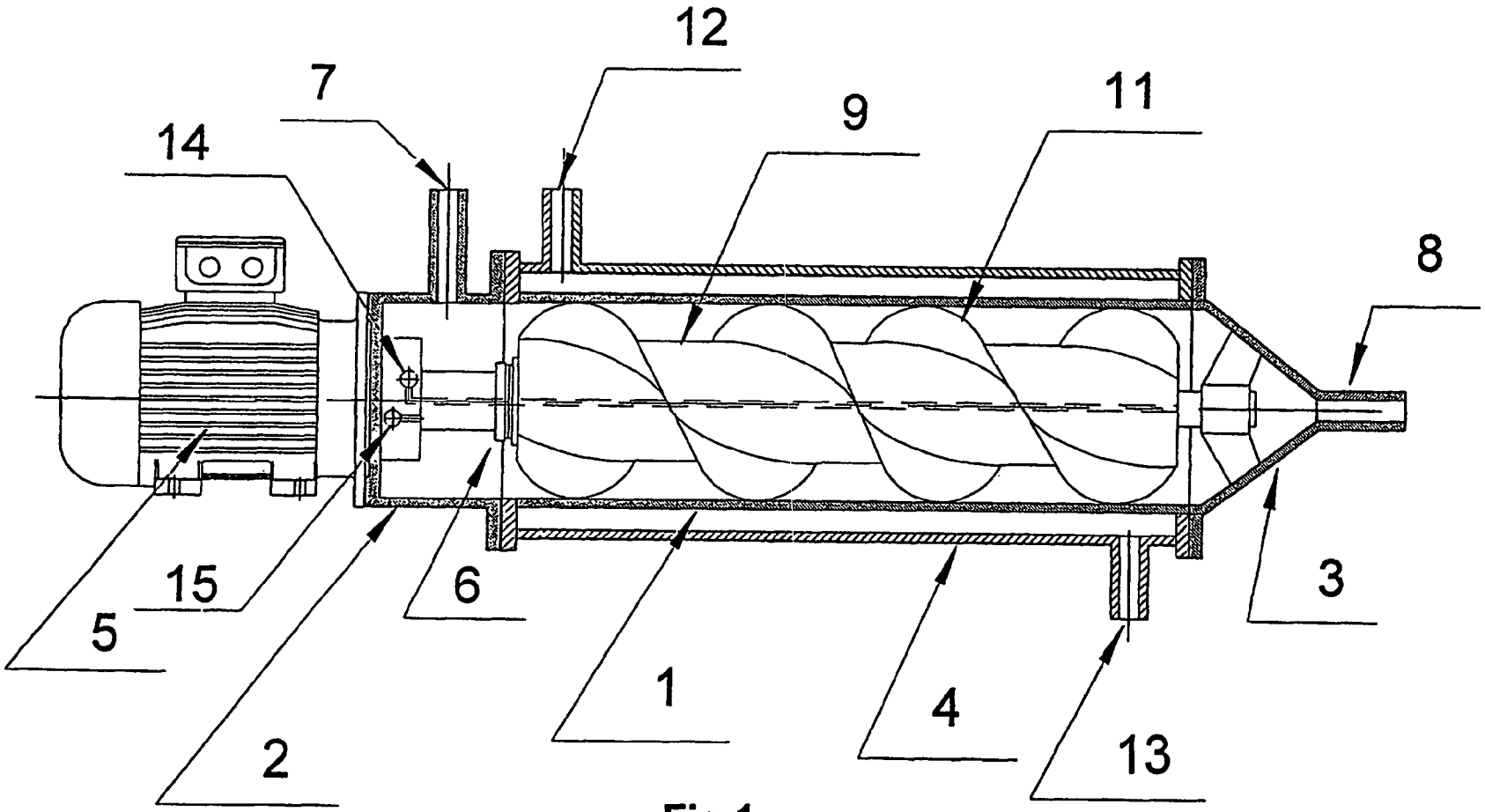

| | | | | |
|---|---|---|---|---|
| 4,557,103 | A | 12/1985 | Schwartz et al. | |
| 4,617,089 | A | 10/1986 | Ullrich et al. | |
| 4,772,177 | A * | 9/1988 | Hayashi | 415/74 |
| 4,793,767 | A * | 12/1988 | Lundin | 415/62 |
| 4,938,660 | A | 7/1990 | Schone et al. | |
| 4,973,708 | A | 11/1990 | Digenis et al. | |
| 5,028,220 | A | 7/1991 | Holdsworth | |
| 5,281,086 | A | 1/1994 | Wissmann et al. | |
| 5,601,414 | A | 2/1997 | Dire | |
| 5,656,286 | A | 8/1997 | Miranda et al. | |
| 5,719,197 | A | 2/1998 | Kanios et al. | |
| 6,013,140 | A * | 1/2000 | Simoneaux | 148/320 |
| 6,394,777 | B1 * | 5/2002 | Haavik | 418/85 |

FOREIGN PATENT DOCUMENTS

| | | | |
|---|---|---|---|
| EP | 0 420 191 | A2 | 4/1991 |
| EP | 0 683 319 | A1 | 4/1995 |
| EP | 0 713 974 | A1 | 11/1995 |
| EP | 0 891 799 | A1 | 7/1997 |
| FR | 854061 | | 5/1962 |
| GB | 3 665 41 | | 2/1932 |
| GB | 4 616 15 | | 2/1937 |
| GB | 1 306 185 | A | 2/1973 |
| GB | 2 076 998 | | 5/1981 |
| JP | 6 008 3556 | | 5/1985 |
| JP | 8 151 113 | | 6/1996 |
| WO | 98 35135 | A | 8/1998 |
| WO | 99/19630 | | 4/1999 |
| WO | 99/19631 | | 4/1999 |
| WO | 00/22301 | | 4/2000 |
| WO | 01/43559 | A2 | 6/2001 |
| WO | 01/48383 | | 7/2001 |

* cited by examiner

SCREW PUMP FOR TRANSPORTING EMULSIONS SUSCEPTIBLE TO MECHANICAL HANDLING

The invention relates to a screw pump for transport of emulsions susceptible to mechanical handling. In particular the invention relates to a particular design of a screw pump that enables it to transport emulsions, such as emulsions used in the food manufacture, without damaging the emulsions due to the mechanical treatment of the emulsions.

BACKGROUND FOR THE INVENTION

Emulsions are mixtures of at least two immiscible phases comprising a continuous phase and one or more discontinuous phases present as small spheres in the continuous phase.

Often the emulsions are composed of an oil/fat phase and a water phase and optionally a gas phase.

Emulsions are widely used within food industry in products such as butter, spread, dressings and toppings; as well as within the non-food industry in products such as lotions, cremes and ointments.

Even though emulsions inherently are inhomogeneous on the microscopic level it is essential for the perception of the emulsions that they appear homogeneous for the consumer both with respect to the visual appearance and the texture of the product.

For emulsions the properties are to a large extend determined by the size of droplets of the discontinuous phase(s) as well as the distribution. Both the visual appearance as well as properties as viscosity, texture, mouth feel, etc, often referred to as functional properties, is influenced by the size and distribution of the droplets of the discontinuous phase(s).

Because emulsions are composed of at least two immiscible phases there is a risk that an emulsion may break and the two different phases may emerge as visible different components in the product, or that droplets of the discontinuous phase coalesce forming larger droplets with the consequence that the properties of the product changes. Breakdown of an emulsion may appear in different ways depending on the extent of the break down of the emulsion and the properties of the emulsion. Breakdown of the emulsion may appear as streaks having a changed colour in the product, parts of the product having different colour, altered texture of the product or a changed mouth feel of the product. Any of these different appearances of the breaking of the emulsion results in a lower quality product and should therefore be avoided if possible.

In the case of gas being one of the phases in said emulsion, damages may appear as gas droplets of an unacceptable size such as above, e.g., 1 mm across or more.

Because the different phases of the emulsions react differently to changing physical parameters, emulsions are susceptible to influences of physical parameters such as temperature and pressure with the consequence that the visible streaks or areas of the emulsion having changed properties emerge and the product becomes less palatable.

These properties of the emulsions require the process equipment to have little impact on the emulsion after the formation during the manufacture of said emulsions in order to obtain an acceptable product. In particular influence on the emulsions by excessive pressure and temperature have to be avoided.

In U.S. Pat. No. 4,938,660 a screw pump for pumping viscous fluids is described. The pump includes a stator and a rotor lying coaxially with each other and has respective surfaces, which lie seal-tight against each other.

WO 99/19630 and WO 99/19631 disclose screw vacuum pumps where the rotors are provided with a cooling system inside the rotors.

In order to improve the stability of emulsions additives such as emulsifiers are often added to the emulsion, with the consequence that the risk for damaging the emulsion is reduced even though it may not be completely avoided.

Consumers' acceptance of additives, particularly in food products, has declined. Therefore, there is an increasing desire and demand for food products containing low amounts of additives or even completely without additives. This has led to productions of food emulsions, such as dairy products, butter, margarine products, margarine, spread, dressings and toppings containing smaller amounts of emulsifiers, preferably completely without additions of emulsifiers, with the consequence that these products are very susceptible to temperature and pressure influences, which makes them difficult to handle using existing process equipment without damaging the products.

The object of the present invention is to provide new improved screw pumps for susceptible emulsions, which reduce the risk for damaging a susceptible emulsion during pumping.

SHORT DESCRIPTION OF THE INVENTION

The inventors have surprisingly realized that the above object may be met by a screw pump for transporting a viscous product comprising a cylindrical housing (1) connected to a removable bottom piece (2) in one end and a removable cap (3) in the opposite end, a rotor (9) having one or more screw blades (11) connected to a driving motor (5), an inlet (7) and an outlet (8), wherein the cylindrical housing (1) is provided with a jacket (4) for supply or removal of heat, and the rotor (9) is provided with means for supply or removal of heat.

Such a screw pump according to the invention has shown to be able to transport of a viscous fluid in particular an emulsion in a gentle way without excessive influences of heat or pressure to the product.

In one embodiment the screw pump according to the invention is used to transport of emulsions, in particular within the food industry.

The design and operation of the screw pump ensures that the pressure of the product entering the pump is essentially maintained throughout the pump. Further the jacket (4) surrounding the cylindrical housing and the means for supply or removal of heat inside the rotor (9) ensures that the temperature of the product may be kept within narrow limits during the transport which, combined with the constant pressure, ensures that said susceptible emulsions may be transported in a gentle way using this pump with low risk of damaging the emulsion.

SHORT DESCRIPTION OF THE DRAWING

In the drawing one embodiment of the screw pump according to the invention is shown. The cylindrical housing (1) is connected to a removable bottom piece (2) provided with an inlet for the product (7), and a removable cap (3) provided with an outlet for the product (8). The rotor (9) is connected to the driving motor (5) via a shaft connected to the bottom piece via a common shaft seal (6). The rotor (9) is provided with two screw blades (11). Surrounding the cylindrical housing (1) is a jacket (4) for supply or removal of heat provided with an inlet (12) and an outlet (13) for a heat transfer medium. The rotor is provided with an inlet (14) and an outlet (15) for a heat transfer medium connected via a channel inside the rotor, indicated in the figure by dashed lines.

DETAILED DESCRIPTION OF THE INVENTION

The term emulsion according to the invention is to be understood as emulsions in the general understanding of the term. In particular the screw pump according to the present invention is useful for emulsions comprising an oil/fat phase and a water phase and optionally a gas phase. Such emulsions may in relation with transport be regarded as fluids having high viscosities.

As the person skilled in the art will appreciate pumping of a fluid depends on the rheological properties of said fluid.

The emulsions to be used in the pumps according to the invention are emulsions having viscosities higher than 100 cP, preferably higher than 500 cP and most preferred higher than 1000 cP.

Such emulsions usually have viscosities that are strongly dependent on the temperature, where the viscosity decreases when the temperature increases.

Further, the emulsions often behave as non-Newtonian fluids, i.e., the viscosity is dependent on the shear force being applied to the emulsion.

The cylindrical housing (1) of the pump according to the invention has a circular cross section and a length determined by the distance the emulsion has to be transported. It is important that the inner cross section of the cylindrical housing has same area in the complete length in order to secure that no excessive pressure increase or decrease occur. In some embodiments a small difference between the pressure at the inlet and the outlet of the screw pump may be acceptable. Preferably this difference is a decrease of pressure from the inlet to the outlet of the screw pump.

The inner surface of the cylindrical housing has to be smooth in order to avoid deposits of emulsion in irregularities in the surface. Further, such a smooth surface is easier to clean which is advantageous, particularly within the food industry. Preferably, the inner surface is a highly polished surface, most preferred highly polished steel.

Dependent of the particular use the housing may have a length of several meters, such as in the range of 0.2–10 m, preferably 0.5–5 m.

The rotor is arranged concentrically in the housing. In principle, the means for supply or removal of heat arranged inside the rotor may be any means that is capable of delivering or removing heat from the rotor. Several such means will be known by the person skilled in the art. Examples of such means include electrical heating elements and channels for passage of a heat transfer medium. The means for supply or removal of heat may be provided in only a part of the length of the rotor or it may be extended to the total length of the rotor. More than one means for supply or removal of heat may be provided in a rotor, for example, in different sections of the rotor in order to be able to have different temperatures in different parts of the housing, or means for removal of heat as well as means for supply of heat may be provided.

One or more screw blades may be provided on the rotor. Even though there may not be an upper limit for the number of screw blades arranged on the rotor, it is preferred that the number of screw blades is in the range of 1–10, preferably 1–6, and most preferably 2–5. In the case that more than one screw blade is provided, they are preferably placed equidistantly around the rotor, i.e., two screw blades are placed in an angle of 180°, three in an angle of 120°, four in an angle of 90°, etc.

The screw blades may be designed in any known shape. It is preferred that the screw blades are formed in a way so that maximal force applied to the product being pumped is applied in the axial direction and minimal force is applied in the radial direction.

A foldable screw blade is a preferred example of such a design. Foldable screw blades are designed so that the tangent to the screw line becomes propulsion lines. Usually, only the part of the tangent from the point of contact to one of the points of intersection with the cylindrical housing is used. Such screw blades are further characterised in that they in any position have same inclination with planes perpendicular to the screw axis.

The distance between the screw blade(s) and the cylindrical housing is preferably low in order to secure that the amount of material being pumped that is able to escape the pumping between the screw blades and the cylindrical housing is low. The distance between the screw blades and the cylindrical housing may be selected in the range of 0.01 mm and 2 mm, preferably in the range of 0.01 to 1 mm and even more preferred in the range of 0.03 and 0.2 mm.

The edges of the screw blades function to keep the inner surface of the cylindrical housing free of residual material. In one embodiment the edges of the screw blades are made of or provided with a cladding of a hard material, preferably a hard metal.

Channels for the product in the screw pump according to the invention is delimited by the inner surface of the housing, the rotor and the screw blade(s). It is essential for the present invention that the area(s) of the cross section of these channels are the same through the length of the screw pump. In this way it is avoided that pressure differences between different sections of the screw pump arise.

The feature that the cross section of any channel along the screw pump is constant is secured by the fact that the inner diameter of the cylindrical housing and the diameter of the rotor are constant as well as the design of the screw blades.

The height of the channels i.e. the difference between the inner radius of the cylindrical housing and the radius of the rotor is an important factor in determining the rate of heat transfer between the material in the centre of the channel and the heat transfer planes, i.e. the inner surface of the cylindrical housing and the rotor. The person skilled in the art will appreciate that said rate of heat transfer will be higher for a low height compared to a higher height. Further the person skilled in the art will appreciate that for a fluid having a very high viscosity transport of heat will be slower that for fluids having a lower viscosity.

The inner diameter and the diameter of the rotor are preferably selected so that the height of the channels is sufficiently low to secure a suitable heat transfer between the fluid and the heat transfer planes.

The ratio of the diameter of the rotor and the diameter of the inner surface of the cylindrical housing may be selected in the range of 0.25 to 0.98. Preferably the ratio is selected in the range of 0.5 to 0.95, more preferred in the range of 0.65 to 0.9.

The driving force for the rotor is provided with a motor connected to the rotor via a shaft. Such motors and shafts as well as bearings, gaskets sealing rings etc. for such a motor and shaft is well known within the area. Preferably the motor is an electrical motor.

A jacket is provided on the outside of the cylindrical housing in order to supply or remove heat. The jacket may in principle be any type of such jackets known within the area that is able to provide the desired transport of heat. In operation a heat transfer medium is passing through the jacket via an inlet and an outlet. Even though the heat transfer via the cylindrical housing is explained mainly as a jacket passed by a heat transfer medium, the person skilled in the art will appreciate that other means for transfer of heat known within the art may also be applicable according to the present invention.

The heat transfer medium may be any suitable medium for transfer of heat. It is preferred that the heat transfer medium is an aqueous medium, preferably water. The heat transfer medium used in the jacket on the cylindrical housing may be the same or a different medium than the medium used in the means for supply of removal of heat provided in the rotor.

Screw pumps according to the present invention may, in principle, be used for pumping any emulsion that is susceptible to mechanical or temperature damage. The screw pump is particularly suited for pumping emulsion comprising oil or fat, water, and optionally a gas. The dry matter in said emulsion may be found in the range of 0–90%.

As examples of such emulsions can be mentioned dairy products, butter, margarine, margarine products, spread, mayonnaise, dressings, toppings, dough, creams, lotions, ointments etc. Preferably the emulsion is a food.

Such emulsions are susceptible to damage by mechanical handling or by exposure to high or low temperatures, particular if such emulsions are manufactured having a low or no content of emulsifiers.

Further the rheological properties of such emulsions are highly dependent on the temperature, where a higher temperature generally leads to a lower viscosity.

Viscosities of the emulsions to be pumped by the screw pump according to the invention is generally higher that 100 cP, preferably higher than 250 cP.

During operation the rotational speed of the rotor may be in the range of 10–800 rpm, preferably 25–500 rpm in order to secure a low mechanical burden on the product.

The temperature of the product is generally sufficiently high to ensure that the viscosity is suitable to enable pumping of the product, but sufficiently low to avoid damaging the emulsion.

For food emulsions the temperature is generally within the range of −25 to 85° C., preferably 0 to 50° C., more preferred in the range of 10 to 40° C.

In one embodiment the screw pump according to the invention is operated so that the temperature in the proximity of the inner surface of the cylindrical housing is different from the temperature in the proximity of the rotor. By operating the screw pump according to the invention in this way different viscosities may be obtained at different locations in the pump.

For example, the temperature of the jacket may be adjusted to be low in order to obtain a high viscosity reducing the amount of emulsion that escapes between the screw blades and housing, whereas the temperature of the rotor may be adjusted to a higher temperature in order to provide a lower viscosity of the emulsion next to the rotor and thereby facilitate transport of the emulsion.

The screw pump is operated so that essentially no pressure gradient is formed between the inlet and the outlet.

The screw pump according to the invention is now described in further details in the following examples, which are provided only for illustration of the invention and should not be understood as limiting in any way.

EXAMPLES

For the examples a screw pump having an inner diameter of the cylindrical housing of 105 mm and a diameter of the rotor of 83 mm was used, provided with a jacket around the cylindrical housing and channels inside the rotor. Heat transfer medium was water for both the jacket and the channels in the rotor.

Example 1

| Water in oil emulsion. | |
|---|---|
| Dry matter | 84% (w/w) |
| Viscosity | 560 cP |
| Inlet temperature | 24° C. |
| Outlet temperature | 12° C. |
| Pressure | 4.6 bar, absolute pressure |
| Rotational speed | 240 rpm |

The emulsion was pumped and simultaneously cooled without damaging of the appearance and the functional properties of the emulsion.

Example 2

| Water in oil emulsion. | |
|---|---|
| Dry matter | 75% (w/w) |
| Viscosity | 820 cP |
| Inlet temperature | 30° C. |
| Outlet temperature | 16° C. |
| Pressure | 5.6 bar, absolute pressure |
| Rotational speed | 240 rpm |

The emulsion was pumped and simultaneously cooled without damaging of the appearance and the functional properties of the emulsion.

Example 3

| Water in oil emulsion. | |
|---|---|
| Dry matter | 42.69% (w/w) |
| Viscosity | 350 cP |
| Inlet temperature | 38° C. |
| Outlet temperature | 18° C. |
| Pressure | 3.6 bar, absolute pressure |
| Rotational speed | 240 rpm |

The emulsion was pumped and simultaneously cooled without damaging of the appearance and the functional properties of the emulsion.

Example 4

| Water in oil emulsion containing gas. | |
|---|---|
| Dry matter | 84.38% (w/w) |
| Viscosity | 176 cP |
| Temperature | 20° C. |
| $N_2$ injected | 13 g/kg emulsion |
| Pressure | 4 bar, absolute pressure |
| Rotational speed | 250 rpm |

The emulsion was pumped without damaging of the appearance and the functional properties of the emulsion.

Example 5

| Water in oil emulsion containing gas. | |
|---|---|
| Dry matter | 75.66% (w/w) |
| Viscosity | 276 cP |
| Temperature | 20° C. |
| $N_2$ injected | 22 g/kg emulsion |
| Pressure | 4 bar, absolute pressure |
| Rotational speed | 250 rpm |

The emulsion was pumped without damaging of the appearance and the functional properties of the emulsion.

Example 6

| Water in oil emulsion containing gas. | |
|---|---|
| Dry matter | 55.18% (w/w) |
| Viscosity | 460 cP |
| Temperature | 14° C. |
| $N_2$ injected | 28 g/kg emulsion |
| Pressure | 4 bar, absolute pressure |
| Rotational speed | 250 rpm |

The emulsion was pumped without damaging of the appearance and the functional properties of the emulsion.

The invention claimed is:

1. Screw pump for transporting a viscous product susceptible to mechanical damage wherein said screw pump comprises a cylindrical housing connected to a removable bottom piece in one end and a removable cap in an opposite end, a rotor having one or more screw blades connected to a driving motor, an inlet and an outlet, said cylindrical housing is provided with a jacket for supply or removal of heat, and the rotor is provided with means for supply or removal of heat.

2. Screw pump according to claim 1, where the viscous product is an emulsion.

3. Screw pump according to claim 1, wherein the means for supply or removal of heat in the rotor is one or more channels inside the rotor connected to an inlet and an outlet for a heat-transfer medium.

4. Screw pump according to claim 1, wherein the distance between the screw blades and the cylindrical housing is between 0.01 and 1 mm.

5. Screw pump according to claim 1, wherein the distance between the screw blades and the cylindrical housing is between 0.03 and 0.2 mm.

6. Screw pump according to claim 1, wherein the one or more screw blades are formed as foldable screw blades.

7. Screw pump according to claim 1, wherein the edge of the one or more screw blades are provided with cladding of a hard metal.

8. Screw pump according to claim 1, wherein the ratio of the diameter of the rotor and the inner diameter of the cylindrical housing is in the range of 0.5–0.95.

9. Screw pump according to claim 8, wherein said ratio is in the range of 0.65–0.9.

10. A method of transporting an emulsion susceptible to mechanical damage having a viscosity higher than 100 cp utilizing a screw pump comprising a cylindrical housing connected to a removable bottom piece in one end and a removable cap in an opposite end, a rotor having one or more screw blades connected to a driving motor, and an inlet and an outlet, the cylindrical housing being provided with means for supply or removal of heat, and the rotor being provided with means for supply or removal of heat, said method comprising the steps of:

supplying heat to the cylindrical housing during transport of the emulsion;

removing heat from the cylindrical housing during transport of the emulsion;

supplying heat to the rotor during transport of the emulsion; and removing heat from the rotor during transport of the emulsion.

11. The method according to claim 10, wherein the emulsion is an emulsion comprising an edible fat and water.

12. The method according to claim 10 wherein the emulsion further comprises a gas.

13. The method according to claim 10, wherein the emulsion is selected among: dairy products, margarine, spread, mayonnaise, dressing, toppings and dough.

14. The method according to any claim 10, wherein the product during the transport is kept at a temperature of between −25 and 85° C.

15. The method according to claim 10, wherein the product is kept at a temperature in the range of 0–50° C.

16. The method according to claim 10, wherein the rotor rotates with a speed of rotation of 10 to 800 rpm.

17. The method according to claim 10, wherein the emulsion is an emulsion comprising an edible fat and water and a gas.

18. The method according to claim 10, wherein the steps of supplying and removing heat to and from the rotor further comprise utilizing one or more channels inside the rotor connected to an inlet and an outlet for a heat-transfer medium.

19. The method according to claim 10, wherein the distance between the screw blades and the cylindrical housing is between 0.01 and 1 mm.

20. The method according to claim 10, wherein the distance between the screw blades and the cylindrical housing is between 0.03 and 0.2 mm.

21. The method according to claim 10, wherein the one or more screw blades are formed as foldable screw blades.

22. The method according to claim 10, wherein the edge of the one or more screw blade is provided with a hard metal cladding.

23. The method according to claim 10, wherein the ratio of the diameter of the rotor and the inner diameter if the cylindrical housing is in the range of 0.5–0.95.

24. The method according to claim 10, wherein the ratio of the diameter of the rotor and the inner diameter of the cylindrical housing is in the range of 0.65–0.9.

* * * * *